US006994079B1

(12) United States Patent
Darlington

(10) Patent No.: US 6,994,079 B1
(45) Date of Patent: Feb. 7, 2006

(54) COMPOUND ARCHERY BOW

(76) Inventor: Rex F. Darlington, 6828 Maple Acres Dr., Whittemore, MI (US) 48770

( * ) Notice: Subject to any disclaimer, the term of this patent is extended or adjusted under 35 U.S.C. 154(b) by 0 days.

(21) Appl. No.: 10/966,167

(22) Filed: Oct. 13, 2004

(51) Int. Cl.
*F41B 5/10* (2006.01)

(52) U.S. Cl. ..... 124/25.6; 124/900

(58) Field of Classification Search ..... 124/25.6, 124/900
See application file for complete search history.

(56) References Cited

U.S. PATENT DOCUMENTS

| | | | |
|---|---|---|---|
| 4,401,097 | A | 8/1983 | Simonds |
| 4,438,753 | A | 3/1984 | Simonds |
| 4,519,374 | A | 5/1985 | Miller |
| 4,774,927 | A | 10/1988 | Larson |
| 4,838,236 | A | 6/1989 | Kudlacek |
| 4,926,832 | A | 5/1990 | Darlington |
| 4,926,833 | A | 5/1990 | Darlington |
| 4,967,721 | A | 11/1990 | Larson |
| 4,976,250 | A | 12/1990 | Jeffrey |
| 4,986,250 | A | 1/1991 | Darlington |
| 5,092,309 | A | 3/1992 | Beaton |
| 5,301,651 | A | 4/1994 | LaBorde et al. |
| 5,368,006 | A | 11/1994 | McPherson |
| 5,433,792 | A | 7/1995 | Darlington |
| 5,505,185 | A | 4/1996 | Miller |
| 5,649,522 | A | 7/1997 | Troncoso |
| 5,678,529 | A | 10/1997 | Larson |
| 5,782,229 | A | 7/1998 | Evans et al. |
| 5,791,322 | A | 8/1998 | McPherson |
| 5,934,265 | A | 8/1999 | Darlington |
| 5,975,067 | A | 11/1999 | Strother |
| 6,082,347 | A | 7/2000 | Darlington |
| 6,112,732 | A | 9/2000 | Larson |
| RE37,544 | E | 2/2002 | Darlington |
| 6,516,790 | B1 | 2/2003 | Darlington |
| 6,666,202 | B1 | 12/2003 | Darlington |

FOREIGN PATENT DOCUMENTS

| | | |
|---|---|---|
| CA | 2183305 | 2/1997 |

OTHER PUBLICATIONS

Mulloney, "One Step Beyond the Compound?" Archery World, Sep. 1976.
"Graham Take-Down Dynabo," Archery World, Jun./Jul. 1980.
Patent application of Larry D. Miller for "Archery Bow Assembly," date and serial number unknown.

(Continued)

*Primary Examiner*—John A. Ricci
(74) *Attorney, Agent, or Firm*—Reising, Ethington, Barnes, Kisselle, P.C.

(57) ABSTRACT

A compound archery bow includes a handle having at least one projecting limb, and a pulley mounted for rotation on the limb. Bow cable segments extend from the bow pulley, including a bowstring cable segment extending from a bowstring let-out groove on the pulley, a second cable segment extending from second cable let-out on the pulley, and a third cable segment extending from a cable take-up groove on the pulley. Draw of the bowstring cable segment away from the handle withdraws the bowstring cable segment from the let-out groove on the pulley and rotates the pulley around its axis, withdraws the first cable segment from the cable let-out on the pulley, and winds the second cable segment into the cable take-up groove on the pulley. The cable take-up groove is contoured such that the draw force on the bowstring cable segment increases as a function of draw to a first level, and then decreases to a second level less than the first level and at which draw force remains substantially constant.

8 Claims, 4 Drawing Sheets

OTHER PUBLICATIONS

Alpine Archery Bow Manual, 1989.

"Instruction Manual—York Thunderbolt DynaBo," York Archery (date unknown).

"M-10 Dynabo Draw Chart," Martin Archery, Inc. (date unknown).

M-10 Cheetah DynaBo Owner's Manual, Martin Archery (date unknown).

FOIG. 10C

COMPOUND ARCHERY BOW

The present invention is directed to compound archery bows having at least one pulley at the end of a bow limb to control the force/draw characteristics of the bow.

BACKGROUND AND SUMMARY OF THE INVENTION

There is a need in the archery field for a special-purpose bow, for youth training applications for example, which can be utilized by a number of individuals of different sizes and strengths without having to be readjusted for each individual. The requirements for differing draw weights (forces) and draw lengths needed to fit a group of trainees, particularly young trainees, can prevent archery from being considered for a group activity because of the need for an instructor to set up a bow for each individual, or for each individual to have his or her own bow. An object of the present invention is to provide a compound archery bow having an extended useable draw length and an adjustable draw force so that two or three bows of the same model can be set up to fit a large group of individuals. Each bow can then be passed from individual to individual without necessitating readjustment of the bow, and an instructor's time can be spent giving shooting instructions.

A compound archery bow in accordance with the present invention includes a handle having at least one projecting limb and a pulley mounted for rotation on the limb. Bow cable segments extend from the bow pulley, including a bowstring cable segment extending from a bowstring let-out groove on the pulley, a second cable segment extending from second cable let-out means on the pulley, and a third cable segment extending from a cable take-up groove on the pulley. Draw of the bowstring cable segment away from the handle withdraws the bowstring cable segment from the let-out groove on the pulley and rotates the pulley around its axis, withdraws the second cable segment from the second cable let-out means on the pulley, and winds the third cable segment into the cable take-up groove on the pulley. The cable take-up groove is contoured in accordance with the present invention such that the draw force on the bowstring cable segment increases as a function of draw to a first level, and then decreases to a second level less than the first level and at which draw force remains substantially constant. The third cable segment preferably is adjustably anchored to the pulley for adjusting the first or peak draw force of the bow. A draw stop preferably is provided on the pulley for engaging the third cable segment to retard further draw of the bowstring cable segment, and most preferably is adjustably positioned on the pulley.

BRIEF DESCRIPTION OF THE DRAWINGS

The invention, together with additional objects, features, advantages and aspects thereof, will best be understood from the following description, the appended claims and the accompanying drawings, in which:

DETAILED DESCRIPTION OF PREFERRED EMBODIMENTS

Figure 1:
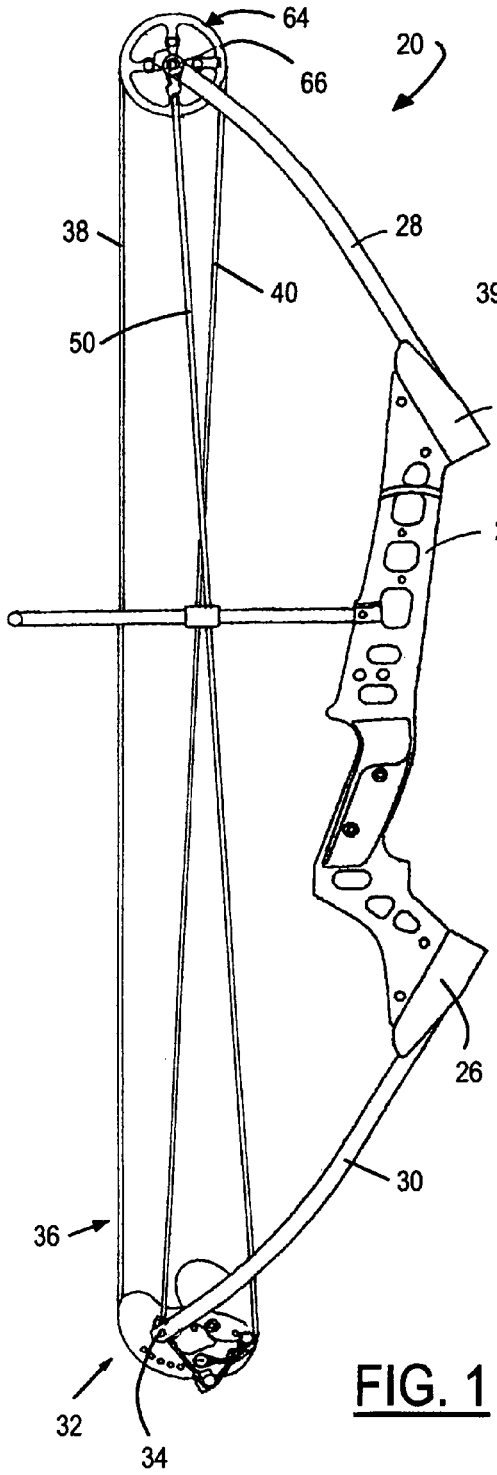
FIG. 1 is a side elevational view of a compound archery bow in accordance with one exemplary embodiment of the invention.
Figure 2:
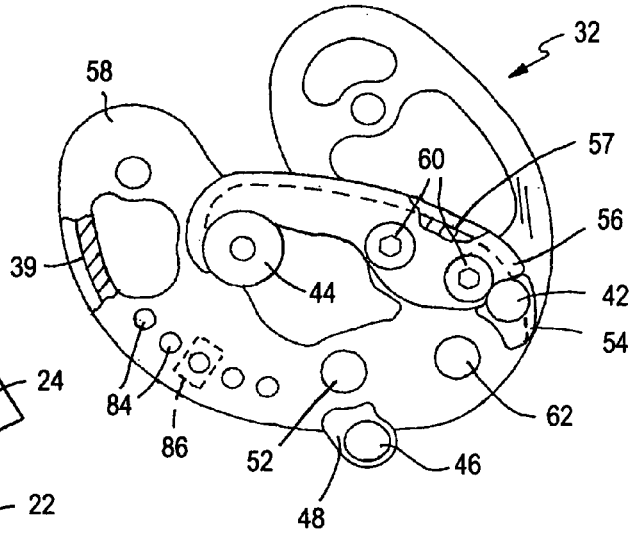
FIG. 2 is an elevational view of the lower pulley or power cam in the bow of FIG. 1.
Figure 3:
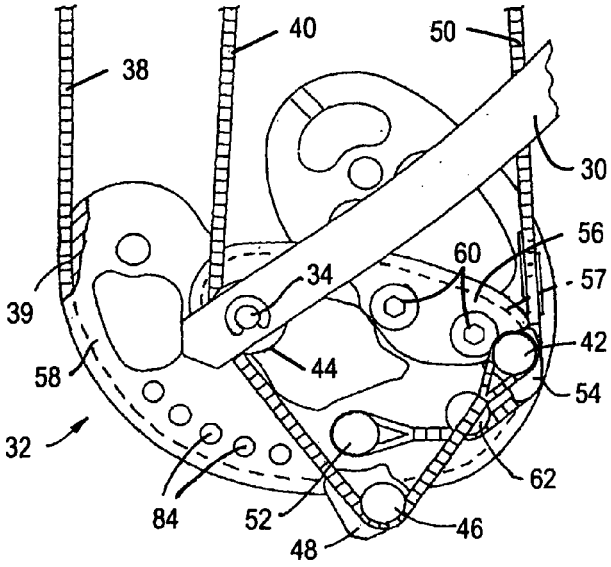
FIG. 3 is a fragmentary elevational view on an enlarged scale of the lower pulley or power cam in the bow of FIG. 1.

FIGS. 1–3 illustrate a single-cam compound archery bow 20 in accordance with an exemplary embodiment of the invention. A handle 22 of aluminum or other relatively rigid construction has spaced risers 24, 26 with a limb receiving surface at each end of the handle. A pair of flexible resilient limbs 28,30 of fiber-reinforced resin or other suitable resilient construction are mounted on respective handle risers 24,26 and project away from handle 22. A first pulley 32 in the form of a power cam is mounted by an axle 34 (FIGS. 1 and 3) at the end of limb 30 for rotation around the axis of the axle. A bow cable arrangement 36 includes a bowstring cable segment 38 that is received in a let-out groove 39 (FIGS. 2 and 3) that extends around the periphery of pulley 32 to an anchor point on the pulley. A second or control cable segment 40 extends around second cable let-out means on pulley 32 to an anchor 42 on the pulley. The let-out means in the illustrated embodiment of the invention include a cable guide 44 at axle 34 and a post 46 on a draw stop 48. Thus, second cable segment 40 extends from anchor 42 around post 46, around guide 44 and thence toward the opposing end of the bow. A third or power cable segment 50 extends from an anchor 52 on pulley 32 around a cable guide 54 toward the opposing end of the bow. Cable guide 54 and a draw length element 56 form a take-up groove 57 (FIG. 2) into which cable segment 50 is taken up or wrapped as bowstring 38 is drawn, as will be described.

In the preferred embodiment of the invention illustrated in the drawings, pulley 32 is in the form of a base 58 on which stop 52, cable guide 54, draw length element 56 and draw stop 48 are mounted. Anchor 42 is mounted on cable guide 54, and post 46 is mounted on stop 48. Draw length element 56 may be permanently secured to base 58, but preferably is a draw length module removably mounted on base 58 by means of screws 60. A second anchor 62 for cable 50 preferably is mounted on base 48, although anchor 52 could be removably positionable to provide anchor 62, if desired. Although a so-called post-feed arrangement is illustrated and currently preferred as the second let-out means for cable segment 40, in the manner of FIG. 28 of Re 37,544, a control arm or the like could be employed as the second cable let-out means in the manner of FIG. 8 of the same patent.

Bowstring cable segment 38, second or control cable segment 40, and third or power cable segment 50 extend from power cam or pulley 32 toward the opposing end of bow 20, as shown in FIG. 1. In the illustrated embodiment of the invention, there is a control wheel 64 mounted on the end of bow limb 28 for rotation around an axle 66. In the illustrated embodiment of the invention, cable segments 38, 40 form a single continuous cable that is trained around a peripheral groove in wheel 64, which is concentric with the axis of rotation of the wheel. In alternative embodiments of the invention, cable segments 38, 40 could be a continuous cable or separate cable segments that are anchored at wheel 64, and the peripheral groove around wheel 64 could be non-circular and/or non-concentric with the axis of rotation of the control wheel, as illustrated for example in the various embodiments of U.S. Pat. No. 6,666,202. Third or power cable segment 50 in the illustrated embodiment of the invention is anchored at the end of bow limb 28. However, cable segment 50 could extend around a let-out groove on the control wheel, as illustrated for example in U.S. application Ser. No. 10/927,764 filed Aug. 27, 2004.

Figure 5:
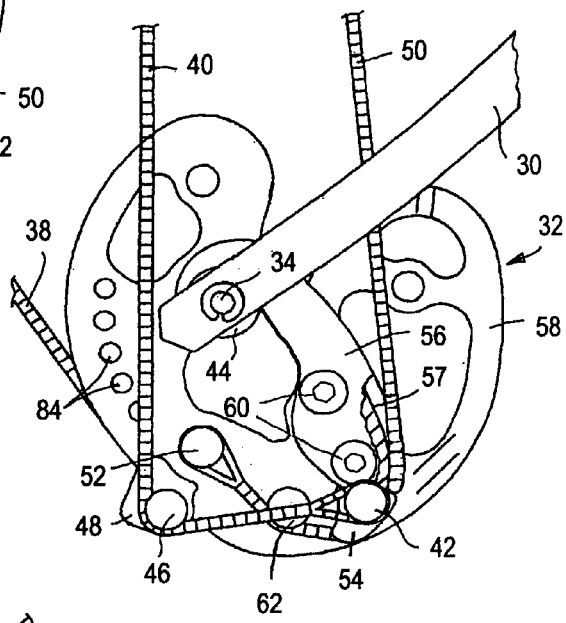
FIG. 5 is a fragmentary elevational view that is similar to that of FIG. 3 and illustrates the power cam or pulley at the peak draw force position.
Figure 6:
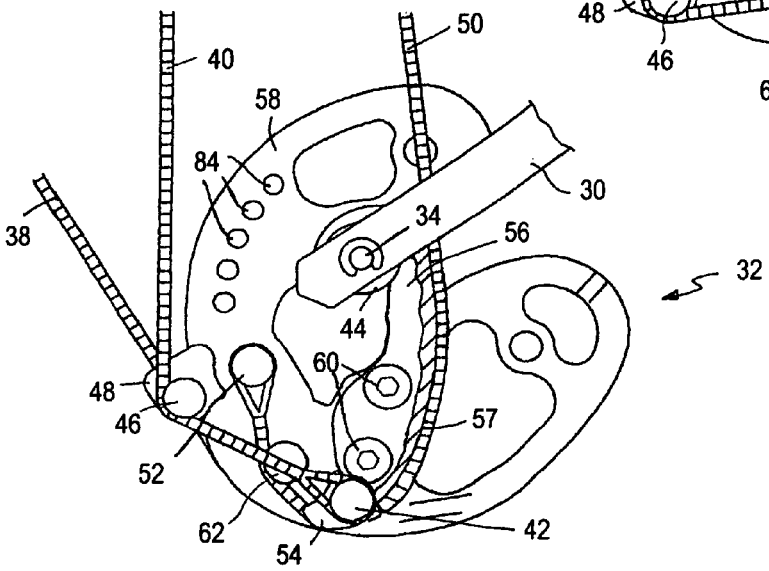
FIG. 6 is a fragmentary elevational view that is similar to that of FIG. 5 but illustrates the power cam or pulley at a draw force let-off position.
Figure 7:
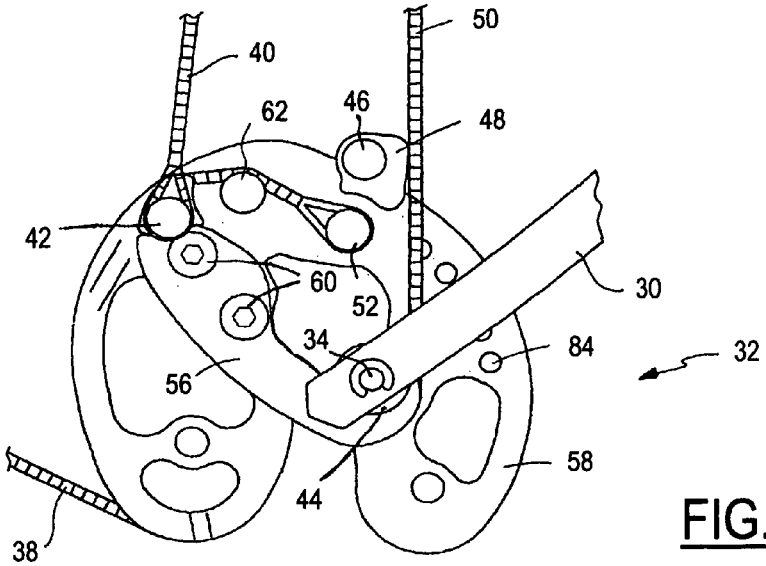
FIG. 7 is a fragmentary elevational view that is similar to those of FIGS. 5 and 6 but illustrates the power cam or pulley at a full draw stop position.

FIGS. 1 and 3 illustrate the rest position of bow 20 and pulley 32. As bowstring cable segment 38 is initially drawn away from the bow handle and bowstring cable is unwrapped from let-out groove 39, pulley 32 is rotated toward the position illustrated in FIG. 5, at which third cable segment 50 begins to wrap into groove 57 of draw-length element 56. At this point, the ratio of the lever lengths between axle 34 and cable segments 38, 50 are such that the draw force on bowstring cable segment 38 reaches a peak 70 (FIG. 8) at a first draw force level (about forty-two pounds in this example). Continued draw of bowstring cable segment 38 further rotates pulley 32, unwrapping bowstring cable segment 38 and second cable segment 40 from the associated let-out groove and means, and wrapping third cable segment 50 into groove 57 on draw length element 56. FIG. 6 illustrates an intermediate position of rotation of pulley 32, at which cable segment 50 approaches axle 34 and draw force is reduced to a second level 72 (FIG. 8) that is substantially less than draw force peak 70 (about twenty-seven pounds in this example). Continued draw on bowstring cable segment 38 ultimately rotates pulley 32 to the position illustrated in FIG. 7, at which draw stop 48 on pulley 32 abuts third segment 50. At this point, the draw force characteristic rapidly increases as at 74 in FIG. 8 to retard further rotation of pulley 32 and further draw on bowstring cable segment 38.

Figure 4:
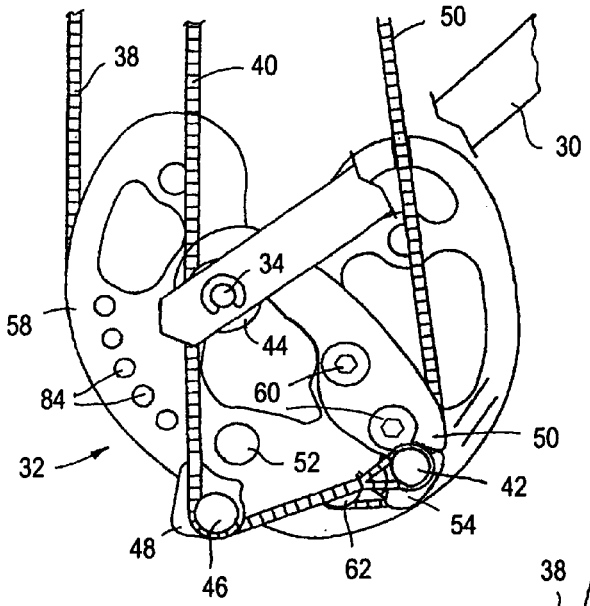
FIG. 4 is a fragmentary elevational view that is similar to that of FIG. 3 but illustrates a peak draw force adjustment to the bow of FIGS. 1 and 3.
Figure 8:
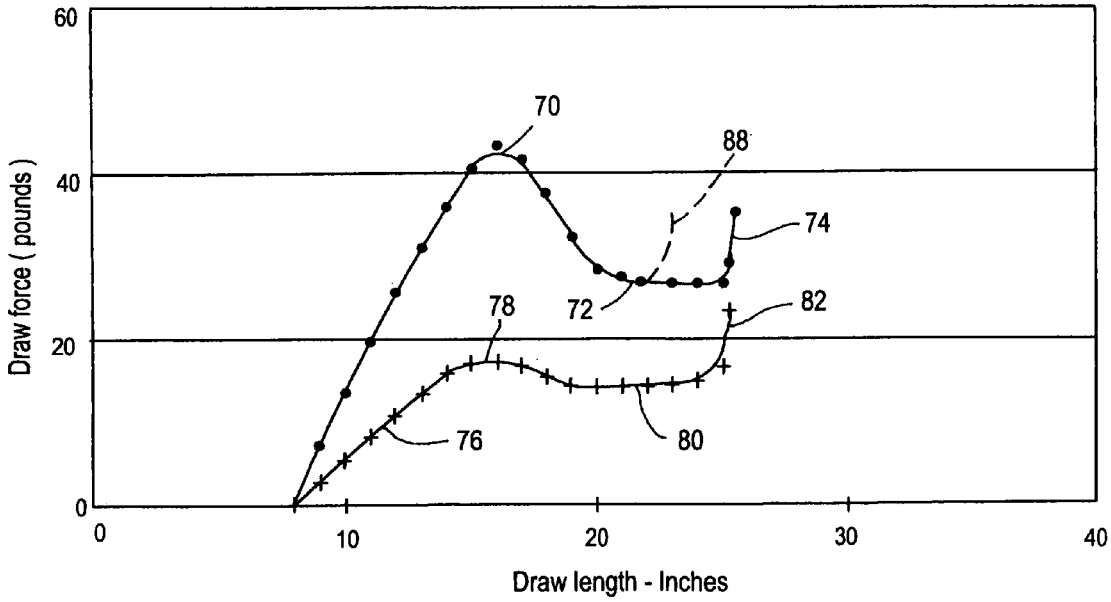
FIG. 8 is a graph that illustrates draw force versus draw length for the bow of FIGS. 1–7.

It would be noted in FIG. 8, in contrast to the force/draw characteristics typical in the art, that draw force peak 70 is reached relatively quickly within a few inches of bowstring draw length (about eight inches in this example), and that the draw force then decreases relatively quickly, again within a few of inches of draw length (about five inches in this example), to a lower plateau level 72. The draw force remains substantially constant at level 72 over several inches of draw length (about five or six inches in this particular example). Thus, this bow can be used by a number of individuals having a draw lengths that differ over a relatively wide range, and not having sufficient strength or skill to maintain draw force peak 70 for the extended draw length. The lower curve 76 in FIG. 3 illustrates the force/draw characteristics of the same bow 20 with the third or power cable segment 50 anchored at 62, as shown in FIG. 4. Again, a draw force peak 78 is reached relatively rapidly, after which the draw force declines to a lower level 80 that is maintained over a substantial amount of draw length, until draw stop 48 abuts cable segment 50 at section 82 in FIG. 8. It will be noted that the draw lengths for the lower curve are substantially the same as for the upper curve.

A number of openings 84 are provided at angularly spaced positions around the periphery of pulley 32 clockwise from draw stop 48 in FIG. 2. A draw stop 86 may be adjustably positioned in any one of the several openings 84 for reducing the effective draw length of the bow, such as to the position 88 shown in FIG. 8. Thus, if a shorter arrow is to be used, for example, the total available draw length of the bow can be adjusted by placing draw stop 86 in one of the openings 84 so that the bow will not be over-drawn such that the arrow falls out of arrow rest on the bow handle.

Thus, the bow of the present invention is characterized in part by the fact that the draw force of the bow increases rapidly with initial draw of the bowstring cable segment, and then decreases relatively rapidly from the peak draw force to a lower relatively long and substantially constant plateau. This feature is achieved in part by the contour of take-up groove 57 in draw length element. Groove 57 is at maximum distance from axle 34 very early during bowstring draw (FIGS. 3 and 5), and thereafter decreases rapidly. Thus, the point of tangency between cable segment 50 and groove 57 rapidly approaches axle 34. This take-up groove contour can be contrasted with the knee-like take-up groove contours in the draw length modules shown in FIGS. 15–17 of Re 37,544 and FIGS. 19–21F of U.S. Pat. No. 6,516,790, for example.

Figure 10A:
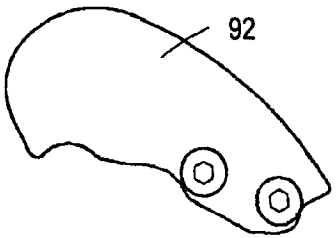
FIGS. 10A to 10B show draw length modules that can be replaceably mounted on the pulley.
Figure 10B:
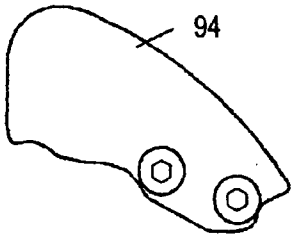
Figure 10D:
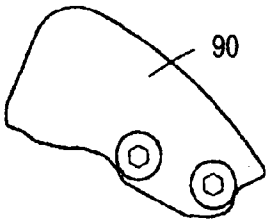
Figure 10D:
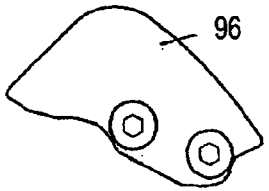
Figure 9:
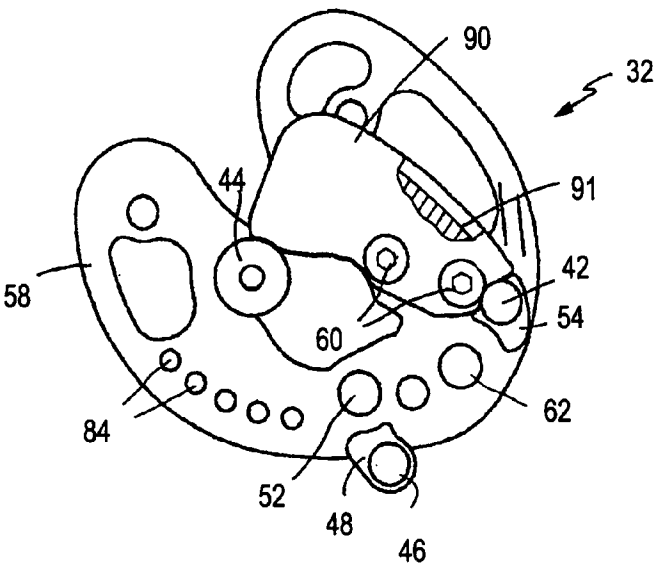
FIG. 9 is a view that is similar to that of FIG. 2, but shows a typical draw length module on the pulley.

Thus, the useable draw length of the bow spans several inches, the peak draw force of the bow can be adjusted more than 20 lbs force, and the draw stop can be adjusted to suit the particular application. This allows two or three bows of the same model to fit an assortment of individuals of different sizes. Furthermore, as an additional advantage of the illustrated embodiment of the invention in which the draw element 56 is removable from the base 58, draw element 56 can readily be replaced by normal adjustable draw length modules of the type illustrated at 90 (with take-up groove 91) to 96 in FIGS. 9–10D. See also FIGS. 19–21F of U.S. Pat. No. 6,516,790, for example, incorporated herein by reference. Thus, a single bow can be used not only for youth training purposes, but also for normal target or hunting applications.

There thus has been disclosed a compound archery bow that fully satisfies all of the objects and aims previously set forth. The invention has been disclosed in conjunction with a presently preferred embodiment thereof, and a number of modifications and variations had been discussed. Other modifications and variations readily will suggest themselves to persons of ordinary skill in the art. The invention is intended to embrace all such modifications and variations as fall within the spirit and broad scope of the appended claims.

What is claimed is:

1. A compound archery bow that includes:

a handle having at least one projecting limb, a pulley mounted for rotation around an axis on said limb, and bow cable means including a bowstring cable segment extending from a bowstring let-out groove on said pulley, a second cable segment extending from second cable let-out means on said pulley, and a third cable segment extending from a cable take-up groove on said pulley, such that draw of said bowstring cable segment away from said handle withdraws said bowstring cable segment from said let-out groove and rotates said pulley around said axis, withdraws said second cable segment from said second cable let-out means and winds said third cable segment into said cable take-up groove, said cable take-up groove being such that draw force on said bowstring cable segment increases, as a function of bowstring cable segment draw away from said handle, to a first level and then decreases to a second level less than said first level and at which draw force remains substantially constant as a function of bowstring cable segment draw.

2. The bow set forth in claim 1 wherein said pulley includes an anchor for said third cable segment.

3. The bow set forth in claim 2 wherein said anchor is adjustably positionable on said pulley.

4. The bow set forth in claim 1 wherein said take-up groove is on a module that is removably mounted on said pulley.

5. The bow set forth in claim 1 including a draw stop on said module for engagement with said third cable segment to retard further draw of said bowstring cable segment.

6. The bow set forth in claim 5 wherein said draw stop is adjustably positionable on said pulley.

7. The bow set forth in claim 1 wherein said take-up groove has a distance with respect to said axle that continuously decreases as a function of draw of said bowstring cable segment.

8. The bow set forth in claim 1 wherein said pulley accommodates as an option a second set of draw modules that allows the bow to function in the normal manner at multiple draw lengths.

* * * * *